US007347333B2

(12) United States Patent
Josephs

(10) Patent No.: US 7,347,333 B2
(45) Date of Patent: Mar. 25, 2008

(54) ULTRA CLEAN AIR SEPARATOR SYSTEM

(76) Inventor: Leroy R. Josephs, 19472 Rye Gate Dr., North Royalton, OH (US) 44133

( * ) Notice: Subject to any disclaimer, the term of this patent is extended or adjusted under 35 U.S.C. 154(b) by 18 days.

(21) Appl. No.: 11/115,883

(22) Filed: Apr. 27, 2005

(65) Prior Publication Data

US 2006/0243645 A1 Nov. 2, 2006

(51) Int. Cl.
*B04C 5/14* (2006.01)

(52) U.S. Cl. ..... 209/720; 209/639; 209/718; 209/719

(58) Field of Classification Search ..... 209/720, 209/137, 139.1, 142, 145, 147, 722, 745, 209/146

See application file for complete search history.

(56) References Cited

U.S. PATENT DOCUMENTS 4,278,532 A * 7/1981 Birch et al. ..... 209/19
4,526,678 A * 7/1985 Myhren et al. ..... 209/2
4,742,919 A * 5/1988 Eriksson ..... 209/44.1
5,184,730 A * 2/1993 Paul ..... 209/142
5,800,578 A * 9/1998 Johnson ..... 55/302
7,128,216 B2 * 10/2006 Kokko ..... 209/639
2006/0096894 A1 * 5/2006 Brandner et al. ..... 209/127.1

* cited by examiner

*Primary Examiner*—Patrick Mackey
*Assistant Examiner*—Terrell Matthews
(74) *Attorney, Agent, or Firm*—Pearne & Gordon LLP

(57) ABSTRACT

A system and process for separating high and low density materials by air flow. Mixed solid material is delivered into an entrance of a cascade separation chamber where it is allowed to free fall and tumble over inclined surfaces. A fan forces air through a "closed" path that includes a duct from the fan outlet to return air to the separation chamber, and a branch duct that supplies an air knife disperser arranged to direct a high velocity air jet against free falling material in the chamber. The fan draws air that has entrained relatively light materials in the chamber, and thereby separates the same from the heavy materials, from the chamber through a duct connected to the inlet of an air cleaning device such as a cyclone separator. Cleaned air exhausted from the cyclone cleaning device and driven by the fan is continuously returned to the separation chamber. Air flow through the chamber is generally in counter-flow relation to the movement of heavy material through the chamber.

8 Claims, 3 Drawing Sheets

ULTRA CLEAN AIR SEPARATOR SYSTEM

BACKGROUND OF THE INVENTION

The invention relates to apparatus and processes for separating solid materials of different density with air flow.

PRIOR ART

Recycling of waste material is an application of a process where materials can be separated on the basis of density. The materials are subjected to a powerful air stream that can separate and/or carry off the less dense materials from the more dense materials. A specific example of an application in which air separation processes are used such as is in the recycling of automobiles and the like, which begins by shredding them in a hammer mill or other apparatus. The shredding process generates a mixture primarily of metal and "fluff", the latter being typically formed of upholstery, carpeting, soundproofing, hoses, ducts, and similar materials. It is important to separate the fluff from the metal components to obtain a higher purity and, therefore, more valuable recycled metal product. It is known to separate mixed shredded material such as produced from shredding automobiles in a chamber where the material is arranged to cascade or tumble such as in a Z box or transfer chute with air flowing in counter-flow relation to the gravity induced movement of the materials through the chamber. Typically, such systems are "open" in that at least a portion of the air circulating through the separation system is continuously released to the atmosphere.

SUMMARY OF THE INVENTION

The invention provides an air separator process with improved effectiveness and which can be operated as a "closed" system. The invention uses an air knife disperser to direct a high velocity air jet over the material being separated in a zone being swept, at the same time, by a more conventional air flow of greater volume and lower velocity. In the disclosed embodiment, flow from the air knife operates in a cascade separation chamber in the form of a Z box. The air knife, in addition to improving the ability of the system to separate materials, enables the system to operate as a closed air circuit, thereby avoiding potential air pollution and/or the need for supplemental air cleaning devices.

In the disclosed embodiment, the separator includes an air circuit having a cyclone separator for removing low density material from the air stream picked up at the cascade separation chamber. A blower or fan of the air circuit forcibly circulates air through the cascade separation chamber and the cyclone separator. A branch line taps a pressure side of the air circuit and conducts air under pressure to the air knife assembly. The outlet of the air knife is advantageously directed to the flow stream of the solid material being separated where it is in a free fall condition and, therefore, fully exposed to the air jet produced by the air knife. The velocity of the air from the air knife is increased over that of the main air flow so that it is particularly effective in separating low density material from high density material even where these materials are physically intertwined or moderately adhering.

DESCRIPTION OF THE PREFERRED EMBODIMENT

Figure 1:
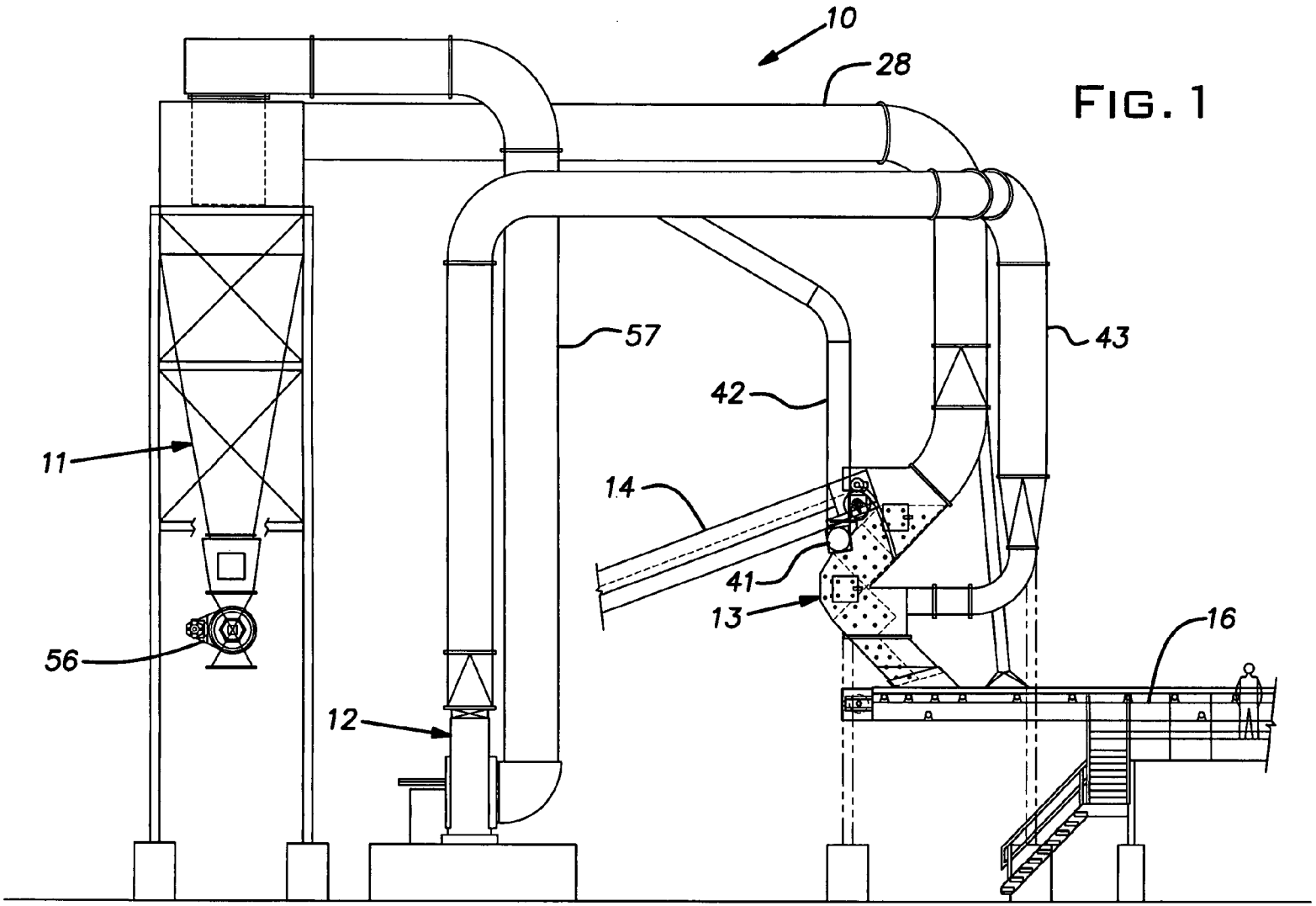
FIG. 1 is an elevational view of an air separator system embodying the invention.

An air separator system 10 includes a cyclone separator 11, fan 12 in the form of a centrifugal blower, and a cascade separation chamber 13. Material to be separated is delivered to the cascade separation chamber 13 by a belt conveyor 14. High density material is carried away from the cascade separation chamber 13 by another or second belt conveyor 16.

The disclosed system 10 is useful in recycling plant operations such as scrap automobiles which are passed through a hammer mill or like apparatus and are shredded or otherwise reduced to relatively small sized chunks or fragments of material, for example, into pieces that can pass through a screen or grid/grate typically having openings of between 4" and 8" but not limited to the same. Such fragmented material exiting the hammer mill and small enough to pass through the associated screen or screens or grids/grate, can be separated to remove non-ferrous metals by suitable methods known in the industry. In the disclosed system, fragmented automobile materials, comprising ferrous material and loosely associated fluff material, are carried by the conveyor 14 into the cascade separation chamber 13. The belt conveyor 14 is driven by a motor reducer set in a conventional manner. It will be understood, that other forms of conveyors such as a vibratory conveyors can be used to transport material into the separation chamber 13. An entrance 17 to the cascade separation chamber 13 receives the discharge end of the conveyor 14 and is provided with an air lock seal of resilient flaps 18 of rubber or other suitable material to substantially prevent air flow through the entrance 17. Where conditions are severe, the flaps 18 can be replaced or supplemented with a rotary seal 20 described below in connection with a conveyor at the cascade separation chamber 13.

Figure 2:
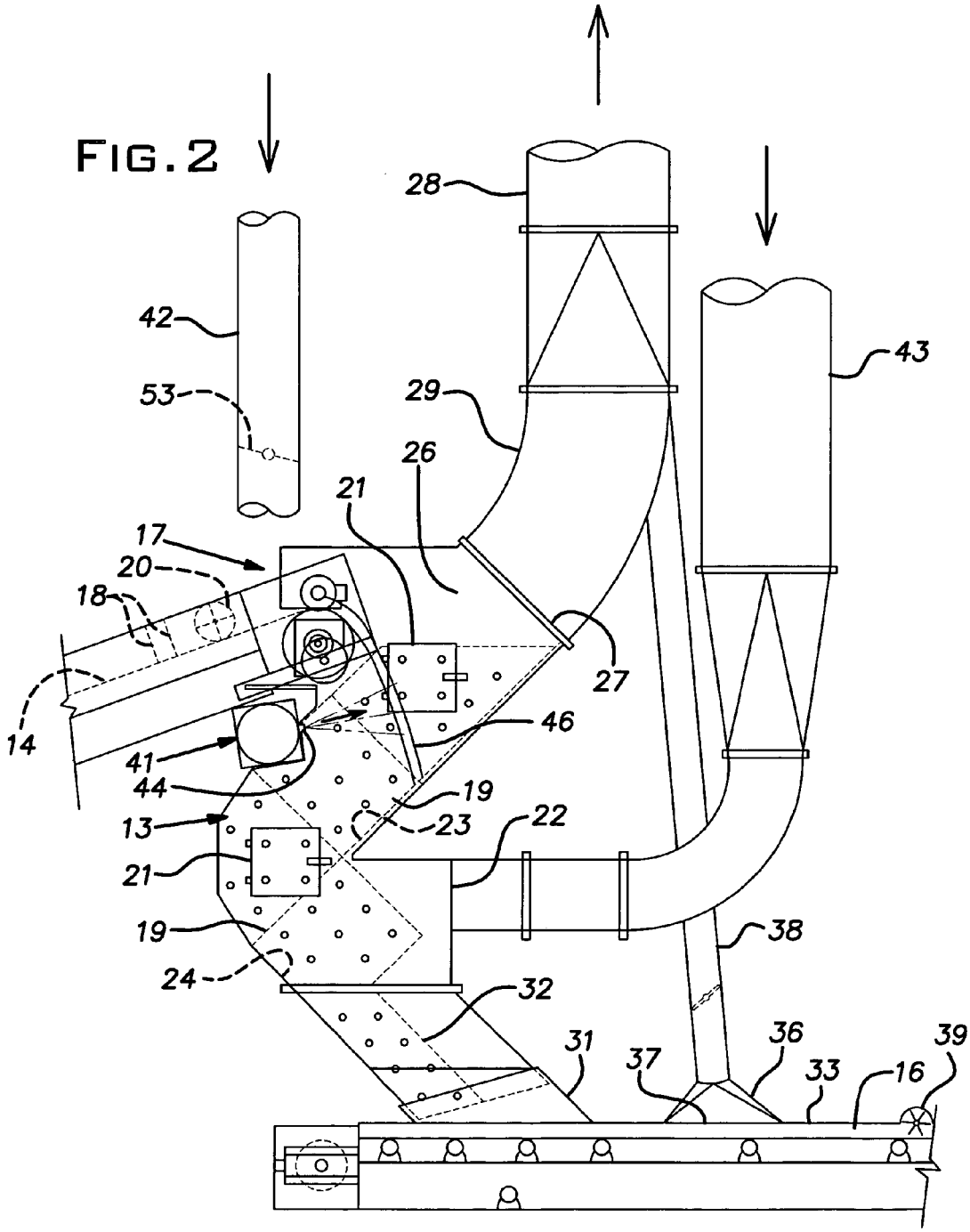
FIG. 2 is a fragmentary view of a portion of the system of FIG. 1 showing an air separation chamber on an enlarged scale.

The chamber 13, in a generally conventional manner, is fabricated of flat steel plates such that it has a rectangular cross-section in planes perpendicular to the plane of the drawing in FIGS. 1 and 2. The interior of the chamber 13 can be lined with replaceable steel wear plates indicated by broken lines 19. Two inspection/maintenance doors 21 are provided to afford vision and access into the interior of the chamber 13. The illustrated chamber 13 which includes an entrance 22 for supply/return air has a "Z" like configuration in the elevational view of FIGS. 1 and 2. This geometry assures that at least the heavier material in the chamber 13 will cascade or tumble under the force of gravity on at least some surface areas in the chamber such as the inclined surface areas 23, 24. As shown, the surfaces 23, 24 are inclined in opposite directions to one another and are perpendicular to the plane of the drawing. Air in an upper region 26 of the interior of the separation chamber or box 13 is exhausted by vacuum/suction through a large rectangular opening or port 27 connected to a return duct or line 28 through an elbow 29.

A covered discharge chute 31 at a lower side of the Z box shaped separation chamber 13 directs material to the material takeaway conveyor 16 operating below the chamber 13 and chute 31. The chute 31 is lined with wear plates indicated by the broken lines 32. A cover 33 extends over a substantial portion of the conveyor 16 and includes an air lock seal 39; an opening 34 in the cover 33 allows the chute 31 to discharge to the conveyor 16. A dust residue takeoff hood 36, with a corresponding opening 37 in the cover 33, is located downstream of the chute 31 with reference to the conveying direction of the conveyor 16. The hood 36 is connected to a vacuum duct 38 that branches into the main return duct 28. A rotary seal 39 can be employed at the downstream end of the hood 36 where excessive dust may discourage the use of simple hanging flaps. The rotary seal 39 has resilient flaps extending radially from a rotary shaft that is power driven at a speed where the flap tips are synchronized with the conveyor speed.

Figure 3:
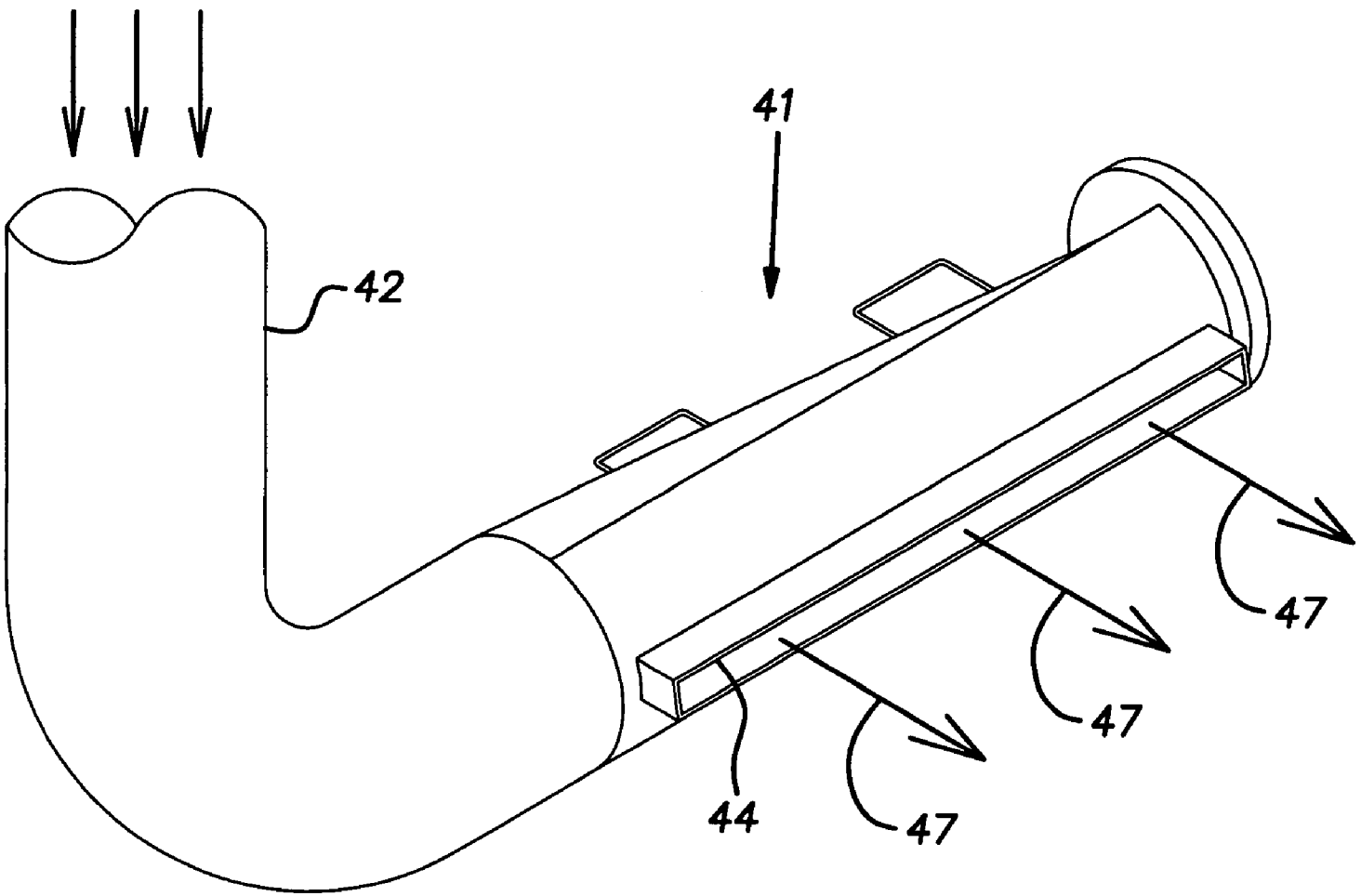
FIG. 3 is a perspective somewhat schematic view of an air knife assembly used with the separation chamber.

An air knife nozzle assembly 41 is disposed to supply a relatively high velocity air flow stream into the path of solid material passing through the separation chamber or cascade box 13. The air knife nozzle assembly 41 is supplied with pressurized air by a branch line 42 connected to a main supply line 43. FIG. 3 illustrates details of the construction of the air knife nozzle assembly 41. The nozzle assembly 41 is an elongated closed end tube fabricated from heavy steel sheet and a half section of steel pipe. The side of the assembly 41 at the separation chamber 13 has an elongated rectangular nozzle opening 44 that extends into the interior of the chamber 13. The area of the nozzle opening 44 is less than the cross-sectional area of the branch line 42 so as to create a high velocity air stream or jet emanating from this opening 44. The nozzle assembly 41 is mounted on the separation chamber 13 by bolts assembled through arcuate slots at its ends that permit limited manual angular adjustment about its longitudinal axis. A damper 53 is positioned in the branch line 42 to adjust the operating pressure in the system 10. Air flow through the air knife assembly 41 improves the separation efficiency of the system and eliminates the need for a stack to discharge air and, potentially, solid material into the atmosphere as has been the prior practice. The damper 53 can be manually adjusted to tune the system air flow and pressure. The branch line 42 can pass about 15%, more or less, of the total flow passing into the main duct from the fan outlet.

In operation of the installation 10, mixed high and low density material, in the described automotive scrap recycling process, being primarily in the form of ferrous metal fragments and fluff comprising mostly organic material such as fragmented pieces of carpeting, upholstery, soundproofing, plastic panels, ducts, tubing, and the like, is delivered into the cascade or separation chamber 13 by the conveyor 14. The initial trajectory or path taken by the material being separated, particularly the high density material, is indicated by the broken lines 46 in FIG. 2. The jet of air discharged from the nozzle assembly 41, represented by the arrows 47 is oriented directly towards the path 46 of material where such material is in a free fall state away from the walls of the chamber 13, particularly the inclined surface 23. The velocity of the air from the air knife nozzle disperser assembly 41 is substantially greater than the average velocity of the volume of air moving through the chamber originating from the entrance 22. The high velocity air jet 47 is effective in dislodging low density material from high density material where it may be moderately mechanically trapped, interlocked, intertwined, adhered or the like with the high density material. Moreover, air flow from the supply line 43 passing through the chamber 13 entrains low density material and drives it generally upwardly through the chamber and causing it to flow with the air through the return line 28, ultimately to the cyclone separator 11. High density material falls by gravity along the path 46 striking the inclined wall liner. This material is thereby caused to tumble into different orientations relative to the main air flow direction through the chamber. This random reorientation and impact shock of the high density material permits the air stream coming from the supply line 43 to scavenge low density material that may not have been dislodged and/or separated from the high density material in the operative area of the air knife, i.e. in the zone between the boundary lines 47. The air knife 41 enables the system 10 to operate as a "closed" system so as to avoid exhaust stacks leading to the atmosphere, typically as found in prior systems.

Air flowing through the chamber 13 and laden with low density material, is delivered into the cyclone separator 11 through the line or duct 28 where, in a known manner, solid materials are caused to drop out of the airstream. Air cleaned in the cyclone separator 11 returns to the inlet of the fan 12 through a duct 57. A rotary valve 56 is energized periodically to discharge collected solids from the lower end of the cyclone separator.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. Apparatus for air separation of solid materials of different density comprising a fan, a substantially closed space, rigid surfaces within the space, an entrance for admitting solid materials of mixed density into the space, a discharge for emptying relatively high density solid materials from the space, an entry for a high volume of relatively clean air into the space from the fan, an exit for air from the space, the space being arranged to direct solid material from the entrance to the discharge in a free fall state away from rigid surfaces in the space, substantially all of the high volume of air flowing from the entry to the exit passing over and sweeping, in counterflow relation, substantially all of the material being directed to the discharge in a free fall state, an air knife directing air at a velocity substantially greater than the average air velocity of the flow of air from the entry to the exit at the material in a path between the entrance and discharge where said material is in a free fall state whereby relatively low density material is separated from relatively high density material, the combined flow of air from the inlet air and the jet air being sufficient to entrain low density material and carry it through the exit.

2. Apparatus for air separation of solid materials of different density comprising a fan, a substantially closed space, rigid surfaces within the space, an entrance for admitting solid materials of mixed density into the space, a discharge for emptying relatively high density solid materials from the space, an entry for a high volume of relatively clean air into the space from the fan, an exit for air from the space, the space being arranged to direct solid material from the entrance to the discharge, substantially all of the high volume of air flowing from the entry to the exit passing over and sweeping, in counterflow relation, substantially all of the material being directed to the discharge, an air knife directing air at a velocity substantially greater than the average air velocity of the flow of air from the entry to the exit at the material in a path between the entrance and discharge whereby relatively low density material is separated from relatively high density material, the combined flow of air from the inlet air and the jet air being sufficient to entrain low density material and carry it through the exit, the air flow through the air knife and the high volume of air being propelled by a common fan.

3. Apparatus as set forth in claim 2, wherein the fan is in the form of a centrifugal blower.

4. Apparatus for air separation of solid materials of different density comprising a fan, a substantially closed space, rigid surfaces within the space, an entrance for admitting solid materials of mixed density into the space, a discharge for emptying relatively high density solid materials from the space, an entry for a high volume of relatively clean air into the space from the fan, an exit for air from the space, the space being arranged to direct solid material from the entrance to the discharge, substantially all of the high volume of air flowing from the entry to the exit passing over and sweeping, in counterflow relation, substantially all of the material being directed to the discharge, an air knife directing air at a velocity substantially greater than the average air velocity of the flow of air from the entry to the exit at the material in a path between the entrance and discharge whereby relatively low density material is separated from relatively high density material, the combined flow of air from the inlet air and the jet air being sufficient to entrain low density material and carry it through the exit, the space being enclosed by walls that cause solid material moving between the entrance and the discharge to tumble in the high volume air stream.

5. Apparatus for air separation of solid materials of different density comprising a fan, a substantially closed space, rigid surfaces within the space, an entrance for admitting solid materials of mixed density into the space, a discharge for emptying relatively high density solid materials from the space, an entry for a high volume of relatively clean air into the space from the fan, an exit for air from the space, the space being arranged to direct solid material from the entrance to the discharge, substantially all of the high volume of air flowing from the entry to the exit passing over and sweeping substantially all of the material being directed to the discharge, an air knife directing air at a velocity substantially greater than the average air velocity of the flow of air from the entry to the exit at the material in a path between the entrance and discharge whereby relatively low density material is separated from relatively high density material, the combined flow of air from the inlet air and the jet air being sufficient to entrain low density material and carry it through the exit, the space being arranged such that the movement of solid material from the entrance to the discharge is in counterflow relation to the high volume flow of air from the entry to the exit.

6. Apparatus for air separation of solid materials of different density comprising a fan, a cyclone separator, a substantially closed space, rigid surfaces within the space, an entrance for admitting solid material into the space, a discharge for emptying relatively high density solid materials from the space, an entry to the space for a high volume of air conducted from an outlet of the fan through a first duct to the entry, an exit for air from the space, the space being arranged to direct solid material from the entrance to the discharge, the high volume of air flowing from the entry to the exit over material being directed to the discharge, an air knife disperser with a nozzle directing air at material moving from the entrance towards the discharge, the fan having an inlet connected by a second duct to an outlet of the cyclone separator, an inlet of the cyclone separator connected by a third duct to the exit of the space, a branch line duct connected between a mid-portion of the first duct and the air knife disperser whereby operation of the fan moves air through all of said ducts, air from said branch line duct through said air knife disperser nozzle impinging on said material to dislodge relatively low density material from high density material, the high volume of air and the air from the air knife disperser collectively making the relatively low density material airborne and entraining it to flow out of said space through said exit and through said third duct to said cyclone separator, the fan, space, cyclone separator and ducts being arranged to form a substantially closed path for air circulation.

7. Apparatus as set forth in claim 6, including a damper in said branch line duct to adjust the air flow through said branch line duct.

8. A method of separating low density and high density materials with air comprising delivering material to be separated into a substantially "closed" chamber, producing a large volume of air flow with a fan, causing the material to be swept with a relatively large volume flow of air of sufficient velocity to make the light density materials airborne while allowing the high density materials to stay out of an airborne condition, diverting a fraction of the air flow from the fan into an air knife disperser nozzle directed towards the material being received in the chamber for separation to enable the air jet of relatively high velocity to impinge on the material to be separated, in the air stream of the relatively large volume flow, to assist in the separation of low density materials from high density materials.

* * * * *